United States Patent [19]

Barnes

[11] 4,161,870

[45] Jul. 24, 1979

[54] MOBILE CARGO-CONTAINER LOCK

[75] Inventor: Robert W. Barnes, Levittown, Pa.

[73] Assignee: Lavelle Aircraft Company, Newtown, Pa.

[21] Appl. No.: 868,881

[22] Filed: Jan. 12, 1978

[51] Int. Cl.[2] ..... E05B 49/00

[52] U.S. Cl. ..... 70/278; 292/150; 292/DIG. 32

[58] Field of Search ..... 70/278, 282, 283, 27 P, 70/280, 281; 361/172; 292/144, 150, 218, 201, DIG. 32; 307/40

[56] References Cited

U.S. PATENT DOCUMENTS

| | | | |
|---|---|---|---|
| 3,731,963 | 5/1973 | Pond | 292/150 |
| 3,795,417 | 3/1974 | Cohen | 292/144 |
| 3,873,892 | 3/1975 | Dettling | 70/278 |
| 3,881,332 | 5/1975 | Ballew | 292/150 |
| 4,038,846 | 8/1977 | Klann | 70/278 |
| 4,082,330 | 4/1978 | McAhorter | 292/218 |

*Primary Examiner*—Robert L. Wolfe
*Attorney, Agent, or Firm*—Florence U. Reynolds

[57] ABSTRACT

A method and electro-mechanical device for locking and unlocking mobile cargo-container doors, utilizing a re-settable electronic combination lock arrangement installed within the cargo container, which electro-mechanically retains a special locking pin inserted through a channel in the container door structure, such locking pin being mechanically coupled to the existing latching handle on the door exterior. The locking pin, when retained by the electronic lock mechanism, restricts travel of the container door handle sufficient to prevent opening of the container door. A keyboard array of switches on the exterior of the cargo container, coupled to the electronic lock circuitry on the container interior, must be actuated in pre-selected code sequence to energize the electronic lock mechanism, thus releasing the locking pin and enabling manual movement of the door handle as required to open the container door.

12 Claims, 4 Drawing Figures

MOBILE CARGO-CONTAINER LOCK

BACKGROUND OF THE INVENTION

This invention relates to a method and to an electro-mechanical device for locking mobile cargo-containers for the purpose of reducing loss of container contents by theft. Such containers can be, but are not limited to: air, sea, and rail cargo containers; truck trailers; vans; rail cars; freight compartments on passenger buses; and the like.

Existing methods of locking cargo containers are generally confined to use of purely mechanical devices, the most common being the conventional key-operated padlock. Other lesser used means include: key-operated mechanical cross-bar locks; conventional mechanical combination padlocks; etc. In some select cases of transport of high value or sensitive cargos, carriers have resorted to welding the container doors shut as a deterrent to theft while the cargo is in transit.

As a supplement to mechanical locking devices, the security industry at times employs self-contained electrical alarm devices to announce unauthorized entry into cargo containers by producing audible siren or bell sounds as a deterrent to theft.

The primary disadvantage to using conventional key or combination operated mechanical locks resides in the difficulty of maintaining limited-access control of the key or combination for such devices. Also it is usually impossible or very difficult to change or alter the key or combination mechanisms when the security control of the key or combination is breached. Once the key is copied or duplicated, or the combination known to unauthorized personnel, the useful life of such device for security purposes is terminated, usually resulting in replacement of such device.

The disadvantage of supplemental electrical alarm devices is that they require a constant electric power source, usually a large battery with sufficient power to drive the alarm annunciator to indicate forced or unauthorized entry to the cargo container. Batteries mounted on the exterior of the cargo container are relatively easy to disconnect or defeat as a means of disarming the alarm, and are further subject to premature failure from extreme temperature variations. Batteries mounted and locked within the cargo compartment may, when exhausted or defective, leak corrosive battery acid which could damage the cargo contents or alarm device.

Prior attempts to develop electro-mechanical locks for mobile cargo-containers have produced devices that proved unreliable or impractical when subjected to the extreme environments and operations encountered in the freight transporting industry. Normally encountered conditions are: extreme temperature and weather variables; heavy shock and vibrations; steam cleaning of the containers; and rough handling of the container interior and exterior while loading and unloading cargo. Exposed interconnecting cables for electrical devices, on either interior or exterior, have proved to be particularly vulnerable to damage from such environments.

Known versions of re-settable electronic combination locks are readily available for use in "fixed" residential, commercial, and industrial installations, but as presently configured are not practical for use as mobile cargo-container locks. Such systems are generally installed in a building subject to minimal environmental changes and are usually coupled to the electrical power source used in the building capable of high electric power demands normally required by conventional electro-mechanical locking solenoids, or audio and visual alarm annunciators. Exposed electrical wiring is generally utilized within the locked room or area to interconnect the lock circuitry to a fixed electric power source, and to the locking solenoid and remote alarm annunciators. The circuits for such electronic combination locks are well known in the art as exemplified by U.S. Pat. No. 3,321,673. That patent utilizes well known techniques of arranging bistable latching multivibrators, or flip-flop stages, in series connection, whereby each preceeding multivibrator stage must be actuated by entry of a keyboard switch signal in a preselected sequence before the succeeding multivibrator will accept the next actuating signal, a pre-determined number of such steps in proper, and re-settable, sequence being necessary to energize and unlatch the lock mechanism.

SUMMARY OF THE INVENTION

The invention relates to a method and device for locking and unlocking a mobile cargo-container having on its door a mechanical latching arrangement operated by a lever-type door handle.

For the locking operation, the door handle is mechanically restrained in closed position by an electro-mechanical locking mechanism located on the interior of the cargo container.

For the unlocking operation, which utilizes an electric power source, a signal generating source located on the exterior of the container is operated in a pre-selected sequence to actuate electronic circuits and an electro-mechanical locking mechanism, thereby causing release of the mechanical restraint to the door handle.

A suitable device for carrying out the method of the invention comprises; an electro-mechanical locking mechanism located on the interior of the cargo container which restrains the container door handle in the closed position by use of a locking pin in contact with the handle and electro-mechanical locking mechanism; and arrangement comprising a re-settable combination lock circuit, signal generating source, and electric power source to operate the locking mechanism.

DETAILED DESCRIPTION OF DRAWINGS

Figure 1:
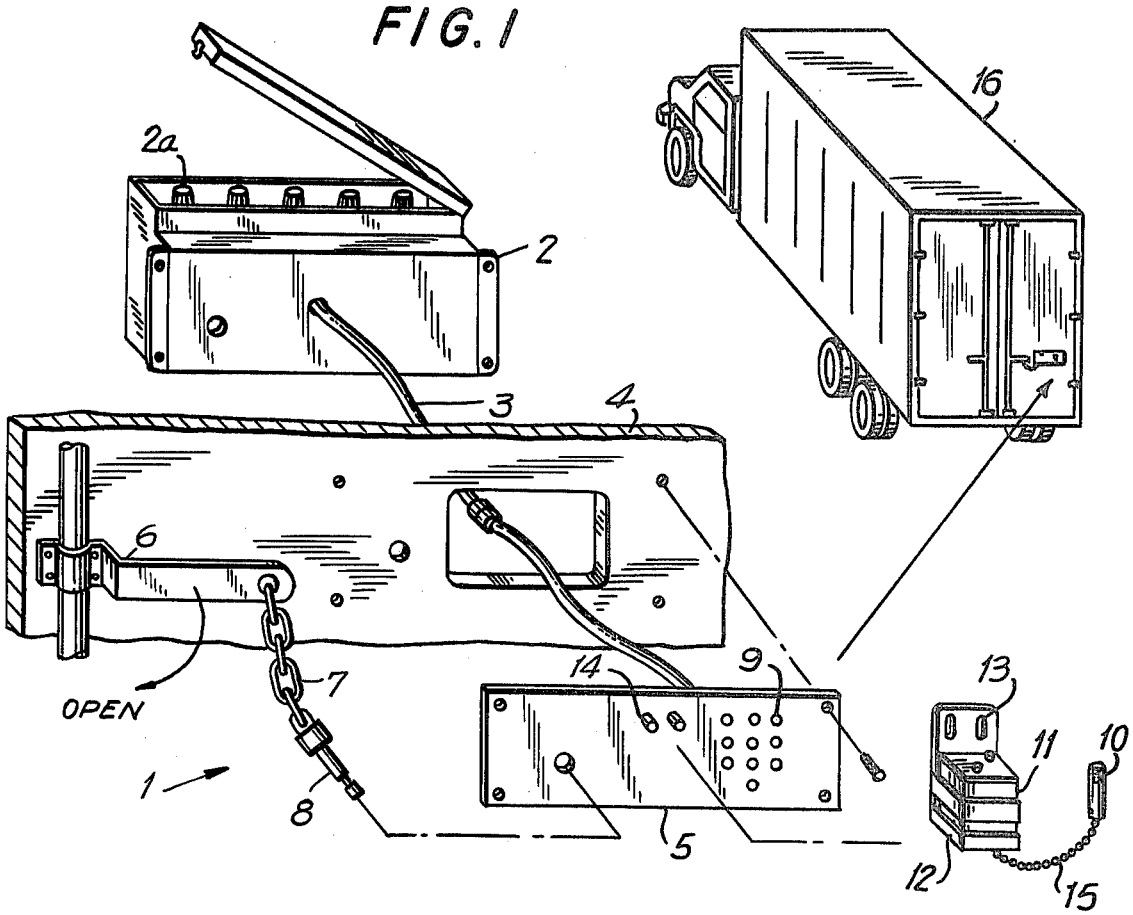
FIG. 1 is an installation view of the invention showing the primary elements in exploded view along with a view of preferred mounting location on a typical trailer truck.

The drawings designated FIG. 1 through FIG. 4 are illustrations of preferred embodiments. The mobile cargo-container lock arrangement in FIG. 1 is designated as 1 and includes enclosure 2, containing the electronic circuits, combination selector controls *2a*, and electro-mechanical lock, coupled by wiring 3 through the cargo container door structure 4 to operate components on the keyboard panel 5 mounted on the exterior of the cargo container. The container door handle 6 is attached to a flexible chain 7, with the other chain end being attached to locking pin 8. The keyboard panel 5 is constructed of a material being of low-permeability to magnetic flux, such as nonmagnetic stainless steel or plastic, through which a plurality of highly-permeable metal rivets 9 are affixed. The rivets 9 form selective paths for magnetic flux to pass through the panel 5 when contacted by the permanent-magnet probe 10, and provides the means of entering coded signals in sequence to the container lock arrangement 1. The portable battery 11 is housed in a carrying case 12 which also contains contacts 13 that connect electric power to the container lock arrangement 1 when case 12 is hung on terminals 14 of keyboard panel 5. The magnetic probe 10 is coupled to the battery carrying case 12 by a chain or cable 15 to prevent loss of probe 10. The cargo lock arrangement 1 is shown installed in preferred location on a typical trailer truck 16.

Figure 2:
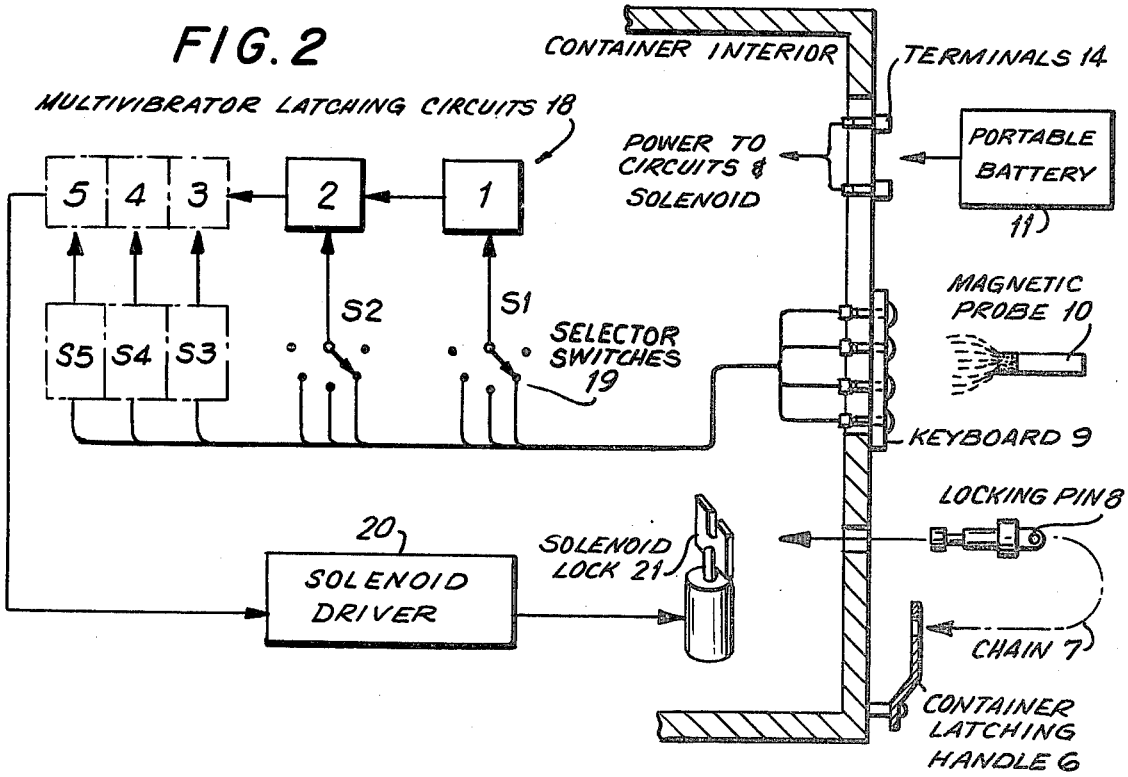
FIG. 2 is an electro-mechanical block diagram illustrating the operation of the invention.

In FIG. 2, the metallic keyboard rivets 9 selectively actuate magnetic reed switches 17 when contacted by magnetic probe 10. The switches 17, when actuated, pass signal voltages to the multi-vibrator latching circuits 18, in pre-selected paths determined by the settings of selector switches 19. When the proper sequence of signals is entered to latching circuits 18, the last circuit stage will signal a solenoid driver stage 20 to energize the electro-mechanical solenoid lock 21, allowing release or insertion of locking pin 8.

Figure 3:
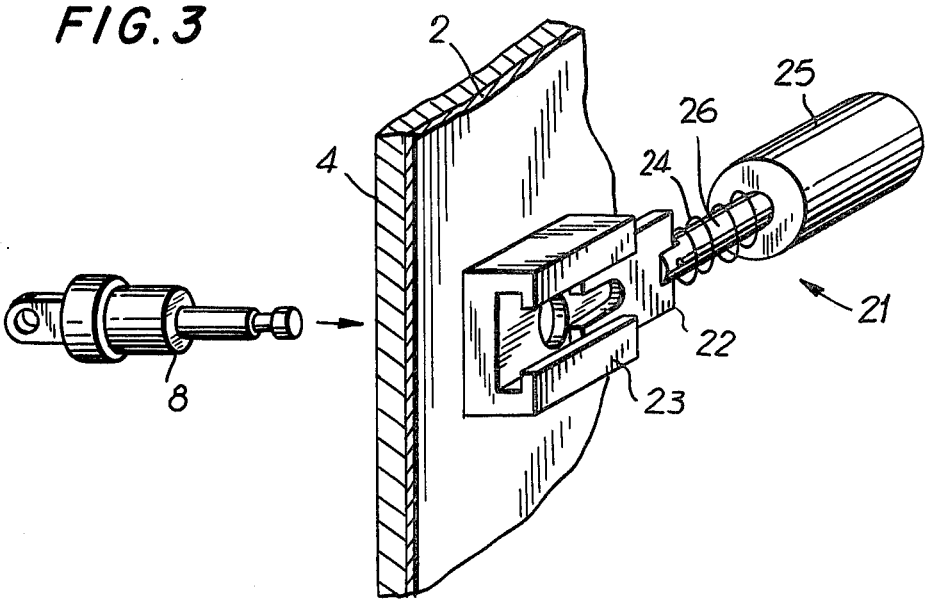
FIG. 3 is a functional illustration of the preferred locking mechanism.

FIG. 3, the electro-mechanical solenoid lock 21 is housed in enclosure 2 and includes a locking-pin retaining yoke 22 which travels in one plane, as controlled by guide block 23. The plane of travel of yoke 22 is at right angles to the path of insertion of locking pin 8 through the container structure 4. The compression coil spring 24 holds yoke 22 in position to retain or prevent insertion of locking pin 8 when solenoid coil 25 is de-energized. When power is applied to coil 25 by the solenoid driver stage 20 of FIG. 2, the solenoid plunger 26 pulls yoke 22 back to a position allowing release or insertion of locking pin 8. When power is removed from coil 25, the spring 24 returns the yoke 22 to the locked position.

Figure 4:
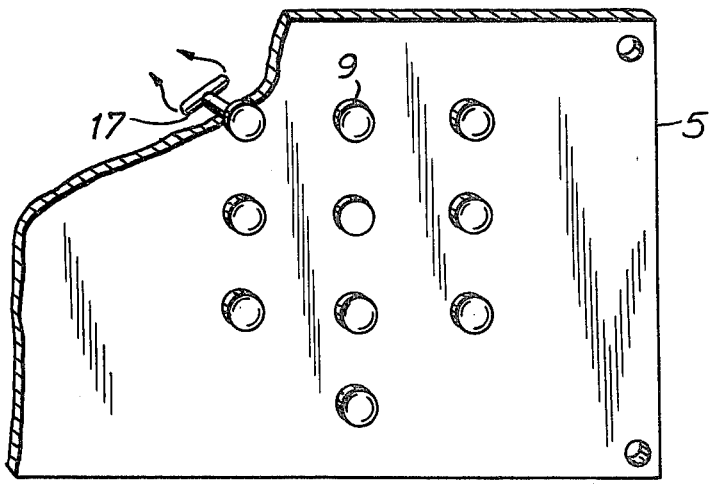
FIG. 4 is a cut-away of the keyboard panel showing the magnetic keyboard elements.

In FIG. 4, the magnetic reed switches 17 are affixed to the highly-permeable rivets 9 which pass through and are permanently fixed to the low-permeability keyboard panel 5. In operation, the magnetic probe 10 of FIG. 1 is brought in contact with a select rivet 9, as a means of actuating the affixed reed switch 17 and entering a signal to the container lock arrangement 1. Repeating this step to prescribed reed switches 17 in a pre-selected sequence will actuate the lock mechanism 21 of FIG. 3 to an unlocked position.

DESCRIPTION OF PREFERRED EMBODIMENTS

The invention as described and illustrated herein forms an arrangement of mechanical elements configured for easy retro-fit installation on conventional cargo-containers. The existing container door handle and latch, when coupled to the add-on elements of the device, form an integral part of the locking system. This eliminates the requirement for installing expensive, heavy-duty electrical latching or locking devices to the door. As a result, power requirements for the locking method of the invention are minimal, allowing operation of the lock using an inexpensive hand-carried battery, which could be easily stored separate from the container, i.e., in a trailer truck cab, or in a truck-terminal office.

Use of an external battery to power the device eliminates the potential hazard of leaking corrosive battery acids within the cargo container interior. Additionally, the external battery feature enables use of the invention on unpowered detached containers such as air and sea cargo-containers, uncoupled trailer containers, and the like. This overcomes the disadvantage of using a battery installed in the container which would result in the inability to unlock the container should the battery fail. The preferred battery would be the inexpensive standard type readily available at hardware and after-hours convenience stores, for ease of replacement.

The ingredients necessary to operate the locking system are: the correct combination code; the proper battery; and the described permanent-magnet probe. This arrangement minimizes the opportunities for entry to the cargo container interior by unauthorized personnel.

The electronic circuitry, re-settable combination switches, and electro-mechanical locking mechanism are housed in a common enclosure, and eliminates the use of exposed electrical cables or moving parts that would be vulnerable to physical damage when loading or unloading the container. The enclosure is mounted inside the cargo container and prevents access to the combination knob settings when the container is locked.

The use of re-settable electronic combination locking circuitry provides a preferred keyless means of locking the container, and easy means of changing the combination code by authorized access-control personnel.

Environmental hazards to the device are minimized by the provision that, except for the face of the keyboard and the readily replaced battery, all operating elements of the device are enclosed within the cargo container away from the weather, and additionally have no exposed moving parts. The face side of the keyboard appearing on the container exterior in preferred construction is made of non-corrosive metal, contains no external moving parts, and is resistant to harsh weather and handling. The battery would be stored in the truck cab or dispatch/receive office, away from harsh weather conditions.

The preferred composition of the panel used for the magnetically operated keyboard would be an non-magnetic stainless steel of the 300 series, for the low permeability quality along with high resistance to corrosion. However, select high-impact plastics or a low-permeable metal such as aluminum could be substituted to achieve similar operating characteristics. Actuating keys on the keyboard panel would by preference be non-moving rivets made of high-permeable stainless steel of the 400 series composition. The use of stainless steel is preferred to handle the additional rigors encountered in normal steam-cleaning of the containers.

The electronic circuitry would by preference be totally embedded in epoxy resin to achieve the shock-resistance features desired in hardware subject to the shock and vibration encountered by trucking and transport containers.

The electro-mechanical locking mechanism design as illustrated enables a loose-fitting parts arrangement to effect ample parts vibration when the container is traveling on the roadway, thus providing a self-cleaning function relative to ejecting debris, ice, and the like that may accumulate in the locking-pin grooves.

An alternate not requiring a chain or cable to couple the door handle to the locking pin, is an arrangement whereby the locking pin is inserted through a hole in the container door handle as a means of handle restraint.

In a preferred construction, all exposed metal parts both inside and outside the container would be stainless steel for corrosion and rust resistance.

The cover lid used on the electronic lock enclosure acts as a rain, snow, and dirt shield over the combination setting knobs, and prevents visible access to the knob settings through peep holes, cracks, and the like in the container structure.

The portable battery is preferably housed in a combination restraint-case and connecting terminal bracket. As illustrated in the drawings, connection of the battery to the electronic lock system is completed when the case containing the battery is hung on the two insulated power terminals protruding from the exterior of the keyboard panel, the suspended weight of the battery being sufficient to hold the mating electrical receptable terminals on the battery case down onto the keyboard terminals.

The device described and illustrated herein is a preferred means of obviating the disadvantages in the prior art where a key padlock or mechanical combination lock can be repeatedly defeated without visible evidence of unauthorized container entry. By construction and design, the invention could only be defeated by forced entry, normally accompanied by physical marks. Forced entry is the method least employed for the theft of cargo contents as experienced by freight carriers.

The invention is not limited to the examples of preferred embodiments disclosed herein, but is understood to include all variations and modifications, which may be made by those skilled in the art, that fall within the scope or underlying principles of the invention.

Mode of Operation

The invention as described provides an accountable system of controlling access to freight contents within a mobile cargo-container. This system limits the number of personnel having access to the freight, and provides a secure locking system for the container while enroute to a delivery destination.

A preferred sequence of operations, typical to the trucking industry, is as follows: (a) the truck is loaded with cargo; (b) the dispatching agent selects a multiple-digit combination and sets the cargo-lock combination knobs on the inside of the truck door accordingly, recording the combination on his copy of cargo manifest or bill of lading; he (c) closes the truck doors and moves the door handles to the locking position; (d) connects the portable battery, normally stored in the truck cab, to the exterior keyboard; (e) uses the magnetic probe to enter his pre-selected combination code and unlock the cargo-lock; (f) inserts the door-handle locking pin, and (g) disconnects the battery to lock the pin in place. Neither truck driver nor anyone else would have access to the combination code while the cargo is in transit. On arrival of the truck at its destination, the receiving agent (h) obtains the combination code from the dispatcher by phone or teletype, duly verified; (i) obtains the portable battery and magnetic probe from the truck driver; (j) and uses the battery and magnetic probe to enter the proper code and unlock the truck doors. In the event of multiple-stop freight deliveries, each succeeding receiving agent resets the cargo-lock combinations using steps (b) through (g) and becomes the custodian of the new combination code for the next leg of the trip.

I claim:

1. A method of locking and unlocking a mobile cargo-container door, having a mechanical latching arrangement operated by a lever-type door handle on the exterior side of said door, said method comprising: for the locking operation, the step of mechanically restraining said handle in the closed position utilizing a de-energized electro-mechanical locking mechanism located on the interior of the cargo container, thereby locking said door latching arrangement in the closed position; and for the unlocking operation, which utilizes an electric power source, the step of operating a signal generating source on the exterior of said container to actuate electronic circuits in a pre-selected sequence causing the operation of said electro-mechanical locking mechanism to the unlocked position, thereby releasing said mechanical restraint on said door handle.

2. A mobile cargo-container, with a door having a mechanical latching mechanism operated by a lever-type door handle on the exterior side of said door, in combination with an integrally installed electro-mechanical locking device comprising: an electro-mechanical locking mechanism installed on the interior of said cargo container; a locking pin adapted to be restrained by said electro-mechanical locking mechanism and adapted to restrain said door handle in closed position by physical contact when said locking pin is restrained by said locking mechanism; a re-settable electronic combination lock circuit comprising a plurality of re-settable combination selector switches, and a signal generating source to actuate said lock circuit in pre-selected sequence through said selector switches; and an electric power source to supply current for operation of said electronic lock circuit and said electro-mechanical locking mechanism.

3. The container combination of claim 2 wherein said lock circuit comprises a series arrangement of bistable electronic latching stages actuated by said signal generating source through said selector switches, and a locking mechanism driver stage adapted to actuate said locking mechanism after said latching stages are actuated in pre-selected sequence.

4. The container combination of claim 2 wherein said signal generating source is a keyboard of manually operable push-button switches positioned at the exterior of said cargo container, and electrically coupled through the cargo container structure to said electronic lock circuit, and wired to selectively apply signal currents to actuate said lock circuit when said push-button switches are operated in pre-selected sequence.

5. The container combination of claim 2 wherein said signal generating source comprises a keyboard panel mounted to the exterior of said cargo container, said panel constructed of a material being of low permeability to magnetic flux, having a multitude of fixed metallic members of higher permeability than said mounting panel passing through said panel and appearing on the exterior side of said panel in a pre-designated fixed keyboard pattern; and a plurality of electro-magnetic reed switches, one each mechanically fixed to the end of each said metallic member appearing on the interior side of said panel, said switches capable of being selectively actuated by placing a permanent-magnet in magnetic contact with the exterior end of said metallic member, said switches being electrically coupled through the cargo container structure to said electronic lock circuit, and wired to selectively apply signal currents to actuate said lock circuit when said reed switches are actuated in pre-selected sequence.

6. The container combination of claim 5 wherein said electro-magnetic reed switches are affixed to the interior side of said low-permeability panel in a pre-designated fixed keyboard pattern, positions of said switches being visually marked on the exterior side of said panel, and said switches being capable of magnetic actuation when said permanent-magnet is placed in contact on the exterior side of said panel at the marked position of the selected reed switch.

7. The container combination of claim 2 wherein said electro-mechanical locking mechanism comprises: a fixed guide block; a locking-pin restraining yoke adapted to slide within said guide block to engage said locking pin at a right angle; a mechanical spring, tensioned to hold said yoke in engaged position to said locking pin; and an electric solenoid which when actuated is adapted to move said yoke, overcoming the preload tension of said spring, to a position of disengagement with said locking pin.

8. The container combination of claim 2 wherein said locking pin is connected to said door handle by means of a flexible cable or chain.

9. The container combination of claim 2 further comprising an enclosure housing said electronic circuitry.

10. The container combination of claim 9 wherein said enclosure also houses said electro-mechanical locking mechanism.

11. The container combination of claim 10 wherein said enclosure also houses said re-settable combination selector switches.

12. The container combination of claim 2 wherein said electric power source is a portable external battery.

* * * * *